US005942703A

United States Patent [19]

Boehnlein et al.

[11] Patent Number: 5,942,703

[45] Date of Patent: Aug. 24, 1999

[54] TREMOLO DEVICE WITH DUAL ARM LEVER

[75] Inventors: John F. Boehnlein, 6206 Timberlane Dr., Independence, Ohio 44131; Francis G. Boehnlein, Independence, Ohio

[73] Assignee: John F. Boehnlein, Independence, Ohio

[21] Appl. No.: 09/110,553

[22] Filed: Jul. 6, 1998

[51] Int. Cl.[6] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 2,741,146 | 4/1956 | Fender | 84/313 |
| 4,171,661 | 10/1979 | Rose | 84/313 |
| 4,457,201 | 7/1984 | Storey | 84/313 |
| 4,497,236 | 2/1985 | Rose | 84/298 |
| 4,852,448 | 8/1989 | Hennessey | 84/313 |

*Primary Examiner*—William M. Shoop, Jr.
*Assistant Examiner*—Shih-yung Hsieh
*Attorney, Agent, or Firm*—Rankin, Hill, Porter & Clark LLP

[57] ABSTRACT

The present invention concerns an adjustment lever or bar for use in connection with a tremolo device. The lever of the present invention serves to facilitate the manipulation or adjustment of the tremolo device while a user is playing the musical instrument. In a preferred embodiment the lever comprises a post for attachment to the base portion of a tremolo device. Extending substantially perpendicular to the post is a first arm and extending at a position substantially diametrically opposed to the first arm is a second arm. The post includes an attachment device or means for removing and attaching the post to the base portion of the tremolo device.

11 Claims, 1 Drawing Sheet

TREMOLO DEVICE WITH DUAL ARM LEVER

FIELD OF INVENTION

The present invention concerns a tremolo device for use in connection with a guitar or similar musical instrument. More particularly, the present invention provides a new and improved lever for a tremolo device.

BACKGROUND

Tremolo or vibrato devices are well-known in the prior art. Tremolo devices are used in connection with guitars and similar musical instruments. Such devices serve to allow the player of a musical instrument to alter the tension of the strings of the musical instrument, thereby changing the pitch of the tone or sound produced by the strings.

Examples of prior art tremolo devices may be found in various patents, such as, Fender U.S. Pat. No. 2,741,146; Rose U.S. Pat. No. 4,171,661; Rose U.S. Pat. No. 4,497,236 and Storey U.S. Pat. No. 4,457,201. In each of these devices a lever having a single arm is manipulated in a vertical direction in order to operate the device and alter the tension on the strings and raise the pitch of the notes produced by the instrument. For many users, the configuration of the current lever is less than desirable.

SUMMARY OF INVENTION

The present invention provides a new and improved adjustment lever or bar for use in connection with a tremolo device. The lever of the present invention serves to facilitate the simultaneous manipulation or adjustment of the tremolo device while a user is playing the musical instrument. No modification of existing tremolo devices is generally required in order to employ the lever of the present invention.

In a preferred embodiment the lever comprises a post for attachment to the base portion of a tremolo device. Extending from the post is a first arm and extending substantially perpendicular to the post at a position substantially diametrically opposed to the first arm is a second arm. The post includes an attachment device or means for attaching the post to the base portion of the tremolo device. Preferably, the attachment means are such that the lever may be easily removed from the base portion when desired by a user. The inclusion of a second arm on the lever allows a user greater flexibility in the manipulation of the lever. This lever also can produce sounds, tones or changes in pitch, not possible with current or conventional tremolo bar designs. For example, the second arm can permit a user to manipulate the lever with the user's forearm, palm, hand or fingers while the user's hand is maintained on or in the vicinity of the strings of the instrument thereby helping a user to continuously play the instrument while simultaneously manipulating the position of the lever.

These and other aspects and advantages of the present invention will be readily understood and appreciated by those skilled in the art from the following detailed description of the invention including the best mode contemplated for practicing the invention in view of the accompanying drawings.

DETAILED DESCRIPTION

Figure 1:
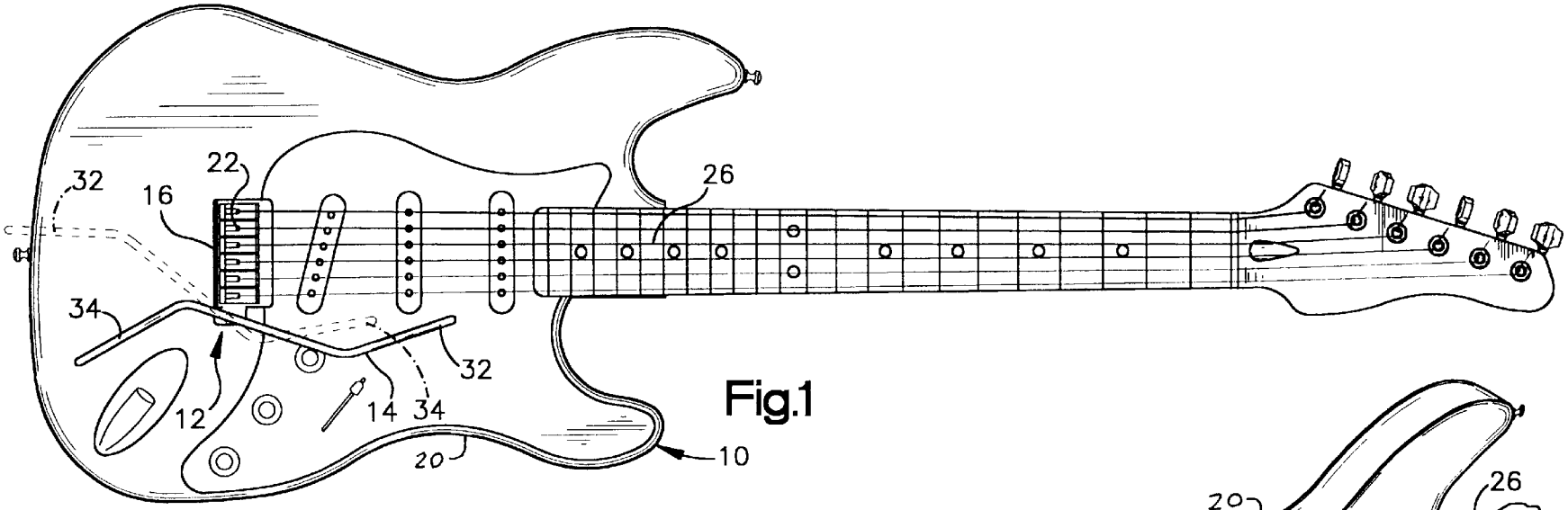
FIG. 1 is a front view of a guitar having a tremolo device having a dual arm lever made in accordance with the present invention.
Figure 2:
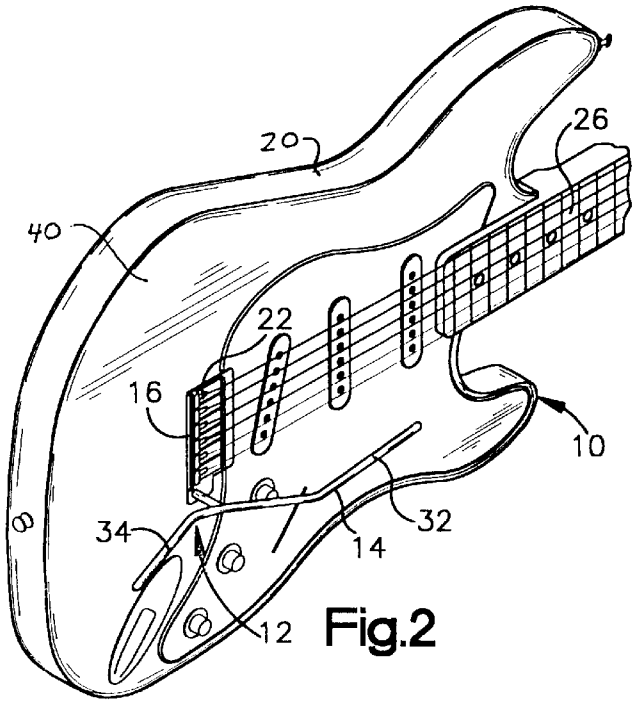
FIG. 2 is a perspective view of the guitar of FIG. 1.

Referring to the drawings and initially to FIGS. 1 and 2 there is shown a musical instrument or guitar 10 having a new and improved tremolo device 12 made in accordance with the present invention. Tremolo device 12 includes an adjustment lever 14 extending from the base portion 16 which is mounted to the body 20 of the guitar 10.

The base portion 16 includes a base plate 22 that is moved by motion of lever 14 thereby altering the tension of the strings 26. Altering the tension of the strings 26 yields a different musical pitch or tone when the instrument is played by the user. Base portion 16 is conventional in nature and is well-known in the prior art. Such base portion may comprise any one or a variety of conventional designs. Applicant hereby incorporates by reference U.S. Pat. Nos. 2,741,146; 4,171,661; 4,497,236 and 4,457,201 for their teachings relating to the design and structure of the base portion of a tremolo device.

Figure 3:
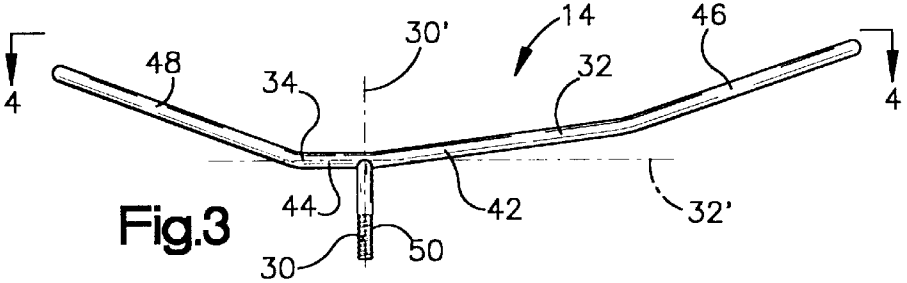
FIG. 3 is a side view of the lever shown in FIG. 1.
Figure 4:
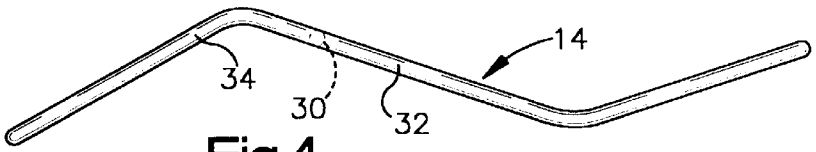
FIG. 4 is a top view of the lever shown in FIG. 1.

Referring now additionally to FIGS. 3 and 4, lever 14 includes post 30 having a first arm 32 and a second arm 34. First arm 32 and second arm 34 each comprise a first portion 42 and 44 and a second portion 46 and 48 respectively. The primary major axes of the post 30, and the first portions of first arm 32 and second arm 34 are referenced as 30' and 32' respectively. As seen best in FIG. 2, the major axis 30' of post 30 extends substantially perpendicular to the face 40 of the body 20 of the guitar 10 when the lever 14 is in its center or middle position. The major axis 32' of the first portion 42 of the first arm 32 extends substantially perpendicular to the major axis 30' of the post 30. Similarly, the major axis 32' of the first portion 44 of second arm 34 extends substantially perpendicular to the major axis 30' of the post 30. Also, the first portion 42 of first arm 32 is located at a position along the post 30 which is substantially diametrically opposed to the position of the first portion of the first arm 32 located along the post 30.

Preferably, as best seen in FIG. 3, the second portions 46 and 48 of first and second arms 32 and 34 are angled slightly relative to the respective first portions 32 and 34. This allows the lever 14 to rock or move up and down relative to face 40 of the guitar with the post 30 being of minimal height. Also, as shown in FIG. 3, the first portion 42 of the first arm 32 may also be angled slightly from the first portion 44 of second arm 34 in order to facilitate the up and down movement of the arm. Of course, the angle of the various portions of arms 32 and 34 can be altered to suit the desires of an end user or the configuration of the face of the particular instrument upon which the tremolo device of the present invention is employed.

Post 30 includes means for releasably attaching the lever 14 to the base portion 16. In FIG. 3 such means includes a threaded portion 50 which allows one to quickly and easily attach the post 30 to the base portion 16. Also, as shown in phantom in FIG. 1, preferably the attachment means allows a user to swing or rotate the lever 14 to more than one position. Of course, it will be appreciated that the post 30 may comprise any number of different configurations or structures to facilitate release and attachment to a base portion such as, for example, a quick release shaft that is releasably received by the base portion with a tension or friction fit, or the post could comprise a threaded portion that is received within a flange and secured with a nut or other retainer or fastener, or the lever could include a female threaded collet designed to engage a male threaded portion extending from the base portion 16.

Lever 14 may be constructed by anyone of a variety of conventional means. For example, post 30 and arms 32 and 34 could be separately produced and then attached together by, for example, welding. Alternatively, arms 32 and 34 could be roll formed or stamped in a continuous manner and then the post could be attached, for example, by brazing, welding or a suitable adhesive. Furthermore, lever 14 could be constructed of any one of a variety of materials such as, for example, a metal such as steel, aluminum or brass, or a material such as wood or fiberglass. Also, the ends of arms 32 and 34 could include knobbed or tapered ends.

Additionally, it will be appreciated that although in the preferred embodiment the lever 14 is illustrated in connection with a conventional 6 string guitar, applicant's lever along with a tremolo device may be employed in connection with any number of stringed musical instruments such as, for example, a bass guitar (4 string), a 7 string guitar or an acoustic guitar.

What is claimed:

1. A tremolo device for a musical instrument having a base portion for attachment to a musical instrument, said tremolo device including a lever extending from said base portion, said lever comprising a post and a first arm and a second arm each having a major axis, said major axis of said first arm extending substantially perpendicular to said post, said major axis of said second arm also extending substantially perpendicular to said post at a position substantially diametrically opposed to said first arm.

2. A tremolo device as set forth in claim 1 wherein said post is releasably attached to said base portion of said tremolo device.

3. A tremolo device as set forth in claim 1 wherein said first arm includes a first portion and a second portion, said first portion being immediately adjacent said post and said second portion extending at an angle relative to said first portion.

4. A tremolo device as set forth in claim 1 wherein said second arm includes a first portion and a second portion, and said second portion extends at an angle relative to said first portion.

5. A lever for use with a tremolo device comprising a post, a first arm having a major axis and a second arm having a major axis, said major axis of said first arm extending substantially perpendicular to said post, said major axis of said second arm extending at a position along said post substantially diametrically opposed to said first arm; said post being capable of releasable attachment to the base portion of a tremolo device.

6. A lever as set forth in claim 5 wherein said first arm includes a first portion and a second portion, said first portion being immediately adjacent said post and said second portion extending at an angle relative to said first portion.

7. A lever as set forth in claim 5 wherein said second arm includes a first portion and a second portion, and said second portion extends at an angle relative to said first portion.

8. A musical instrument having a body portion and a tremolo device mounted to said body portion, said tremolo device includes a base portion mounted to said body portion and an adjustment lever extending from said base portion; said lever comprising a post having a major axis and a first arm having a first major axis and a second arm having a first major axis, the major axis of said post extends substantially perpendicular to the major axis of the body portion of said musical instrument, said first axis of said first arm extends substantially perpendicular to the major axis of said post, and the first major axis of said second arm also extends substantially perpendicular to the major axis of said post and substantially parallel to the first major axis of said first arm.

9. A musical instrument as set forth in claim 8 wherein said musical instrument comprises a device selected from the group consisting of a six string guitar, a bass guitar, or a seven string guitar.

10. A musical instrument as set forth in claim 8 wherein said first arm comprises a first portion and a second portion wherein said second portion extends at an angle relative to said first portion.

11. A musical instrument as set forth in claim 10 wherein said second arm comprises a first portion and a second portion wherein said second portion extends at an angle relative to said first portion.

* * * * *